United States Patent [19]

Itogawa et al.

[11] 4,292,985

[45] Oct. 6, 1981

[54] HAIR WAVING APPLIANCE

[75] Inventors: Zirou Itogawa, Takaishi; Yoshiyuki Aoto, Yoa, both of Japan

[73] Assignee: Sharp Kabushiki Kaisha, Osaka, Japan

[21] Appl. No.: 30,434

[22] Filed: Apr. 16, 1979

[30] Foreign Application Priority Data

Apr. 14, 1978 [JP] Japan ..... 53-49907

[51] Int. Cl.[3] ..... A45D 20/00

[52] U.S. Cl. ..... 132/9

[58] Field of Search ..... 132/9; 34/97-98

[56] References Cited

U.S. PATENT DOCUMENTS

| | | | |
|---|---|---|---|
| 2,559,004 | 7/1951 | Brown et al. | 132/9 UX |
| 3,199,218 | 8/1965 | Bean | 132/9 X |
| 3,343,530 | 9/1967 | Solos et al. | 132/9 X |
| 3,464,425 | 9/1969 | Gagliano | 132/9 |
| 3,588,444 | 6/1971 | Omohundro | 132/9 |
| 3,605,762 | 9/1971 | Fromman | 132/34 R |
| 3,612,069 | 10/1971 | Waters | 132/9 |
| 3,894,546 | 7/1975 | Nolan | 132/9 |
| 3,934,596 | 1/1976 | Suntheimor | 132/9 |

*Primary Examiner*—G. E. McNeill

*Attorney, Agent, or Firm*—Birch, Stewart, Kolasch et al.

[57] ABSTRACT

A hair waving appliance disclosed herein enables hair to be reacted with a waving agent under the heated condition, the temperature and duration of the reaction being adjustable at the user's or beautician's choice. The waving appliance uses rather weak waving agents to assure a desired degree of permanent waving by generating mist at room temperature and supplying the same to hair. Particularly, the waving appliance is provided with a highly reliable support structure by which a controller containing many controlling elements therein is secured on a prop and rotatable within a limited range of angles with respect to a head supporting assembly.

11 Claims, 32 Drawing Figures

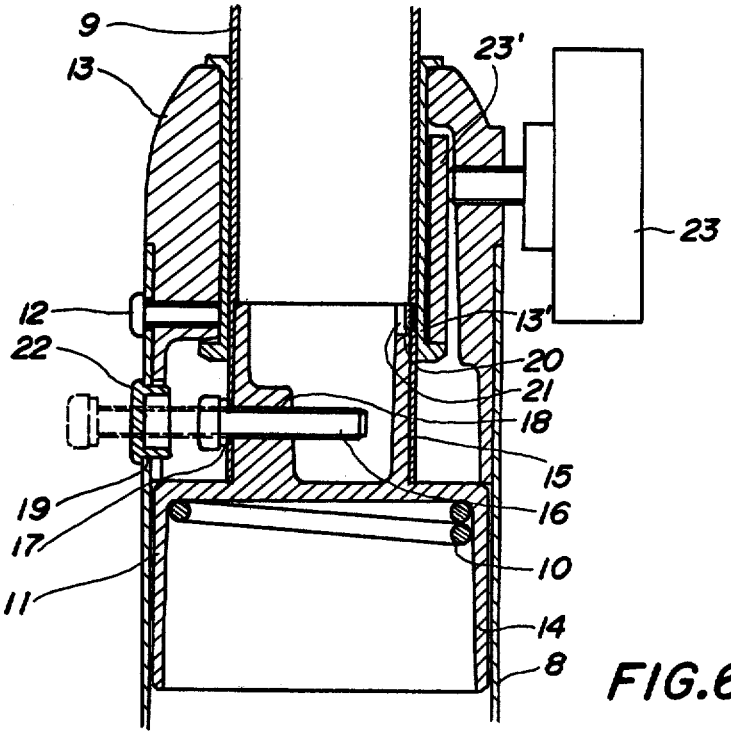
FIG.6
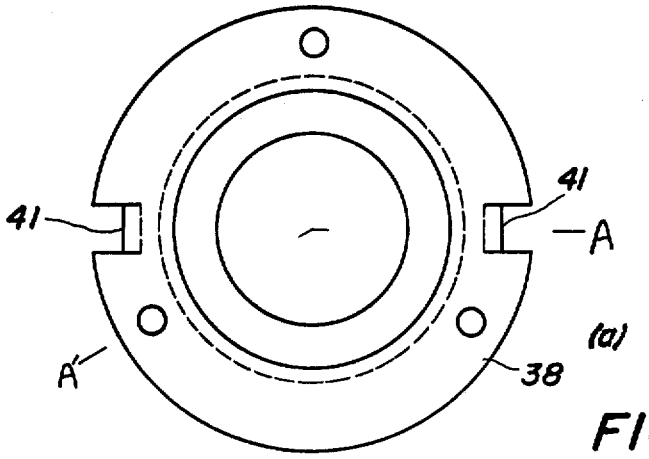
FIG.7
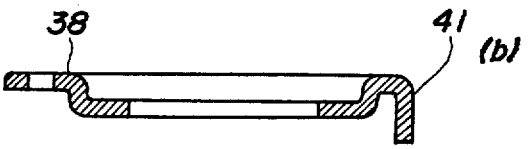

FIG. 8 (a)
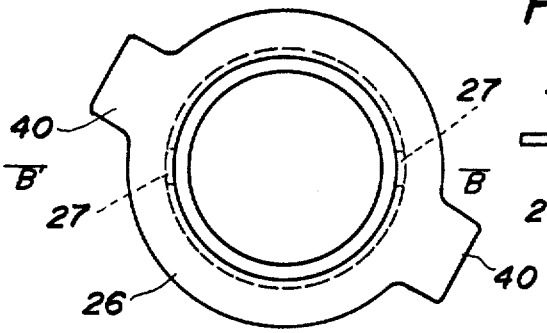
FIG. 8 (b)
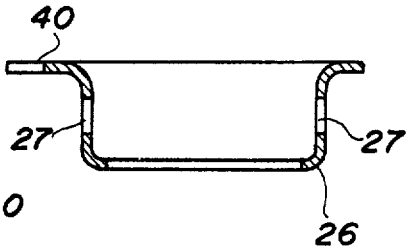
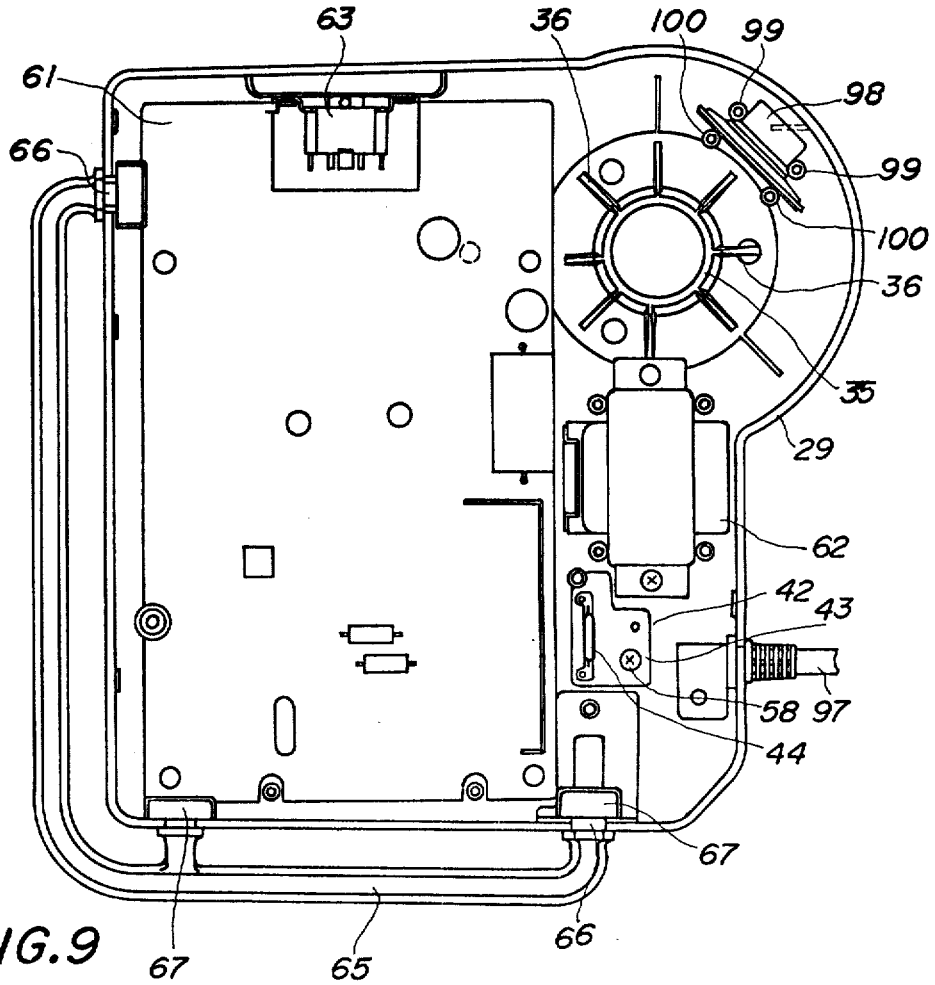
FIG. 9

HAIR WAVING APPLIANCE

BACKGROUND OF THE INVENTION

This invention relates to an improvement in a heating type hair waving appliance.

A conventional way to confer a durable hair wave is to allow a waving agent to react on hair at room temperature. This is called "cold waving". However, in this instance the waving agent, for example, thioglycolate should be strong because it reacts on hair at room temperature. There is a great risk that the waving agent will damage the skin of a beautician and the hair of a patron. In addition, since the period where the waving agent reacts on the hair is determined primarily by feelings and experiences of a beautician, the degree of hair waving would occasionally be too much or too less.

Lately, some approaches to overcome the defects noted above have been suggested, that is, heating types of a hair waveing appliance wherein hair is heated before the reaction of a waving agent. One method of waving hair involves curling the hair about heat-accumulated curler rods to heat the hair and allowing a waving agent to react on the hair. An alternative method of waving hair involves supplying hot air to waving agent laden hair to heat the same during the reaction of the waving agent.

Both methods were effective to weaken the intensity of the waving agent. However, the former suffered difficulties in maintaining the reaction of the waving agent at the optimum temperature and adjusting the reaction period because the temperature of the curler rods falls quickly, while in the latter method there is the likehood of drying the waving agent out by hot air prior to the reaction of the waving agent.

SUMMARY OF THE INVENTION

Accordingly, the present invention overcome the disadvantages noted with the above outlined prior art by providing an improved hair waving appliance of this invention.

Pursuant to one preferred form of the present invention, hair is reacted with a waving agent under a heated condition, the temperature and duration of the reaction being adjustable at the user's choice. It becomes possible to use rather weak waving agents to assure a desired degree of permanent waving by generating mist at room temperature and supplying the same to the hair. This also prevents the drying up of the waving agent. Particularly, the present invention is directed to providing a highly reliable support structure by which a controller containing many controlling elements therein is secured on a prop or stand.

BRIEF DESCRIPTION OF THE DRAWINGS

For a more complete understanding of the present invention and for further objects and advantages thereof, reference is now made to the following description taken in conjunction with the accompanying drawings, in which:

FIG. 6 is an elevational cross-sectional view of a part of the prop structure;

FIG. 7(a) and 7(b) are a plan view and a cross-sectional view taken along the line A—A showing slide fittings;

FIGS. 8(a) and 8(b) are a plan view and a cross-sectional view taken along the line B—B showing a cramping member;

FIG. 9 is a representation of the internal struture of a lower housing member;

DETAILED DESCRIPTION OF THE INVENTION

Figure 1:
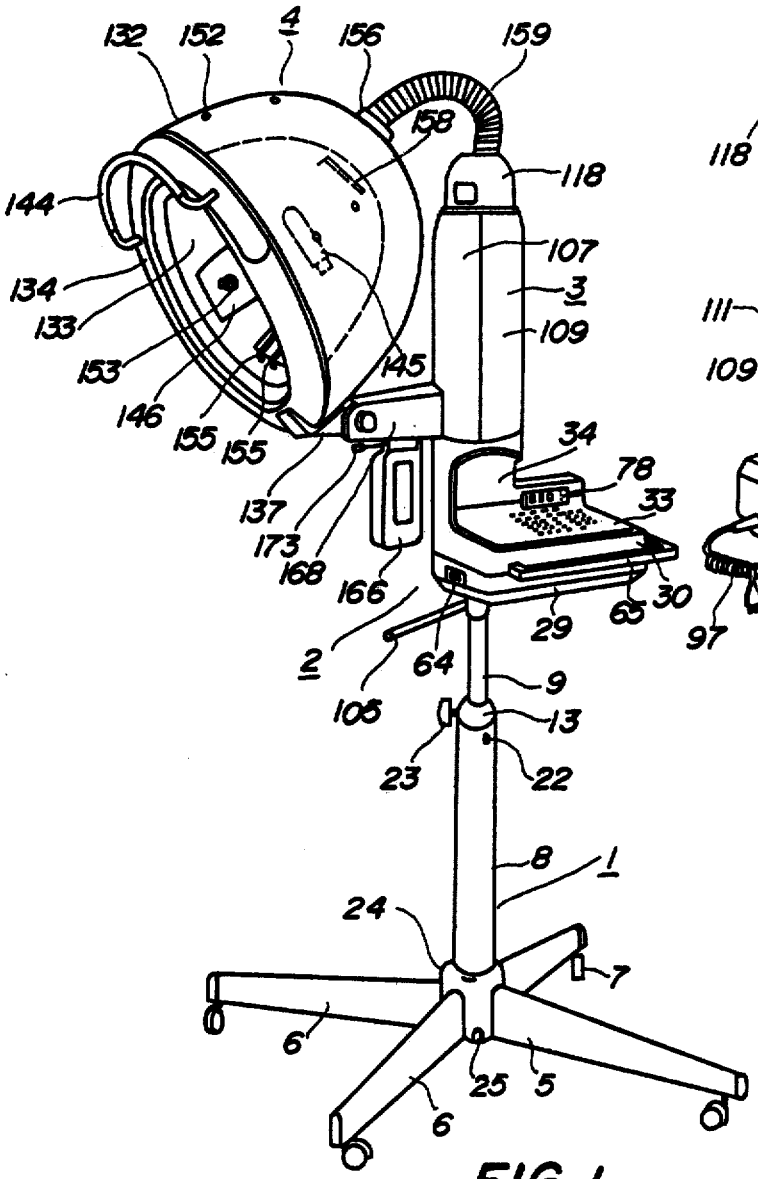
FIG. 1 is a perspective view of a permanent waving appliance according to the present invention.
Figure 2:
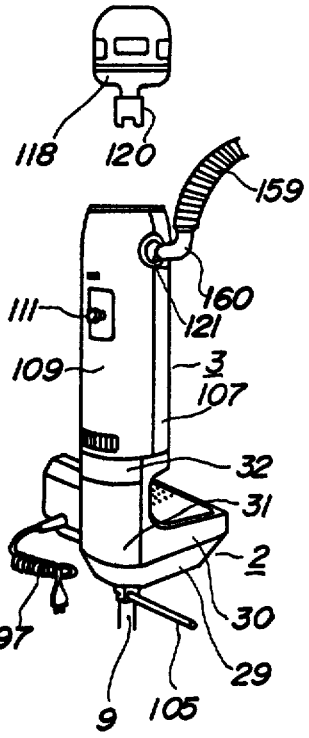
FIG. 2 is a rear view showing a controller and an atomizer contained within the waving appliance of FIG. 1.

Referring now to FIG. 1, there is illustrated a heating type hair waving appliance according to one preferred form of the present invention. The waving appliance generally comprises a prop structure 1, a controller 2, an atomizer assembly 3 and a bonnet 4.

Figure 3:
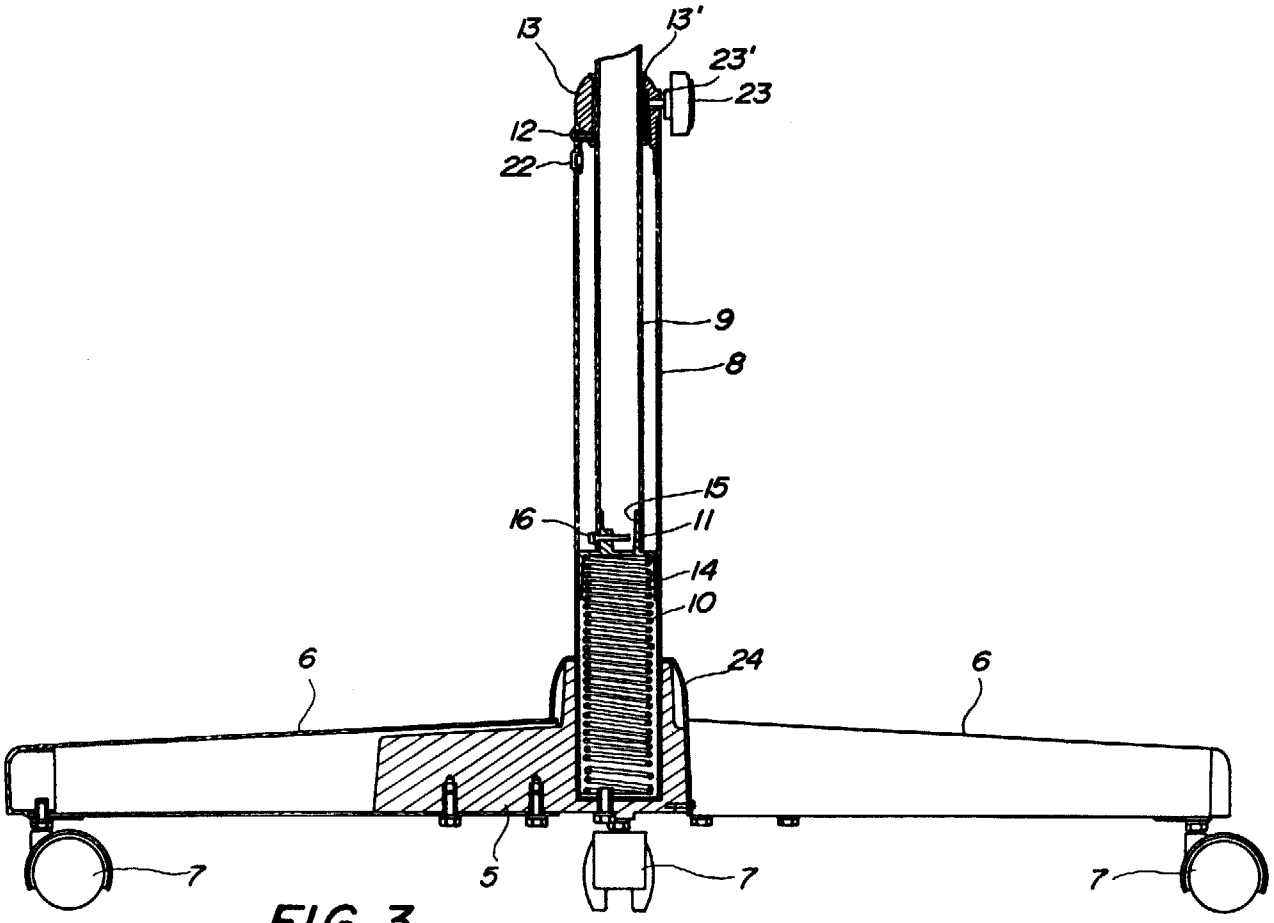
FIG. 3 is an elevational cross-sectional view of a prop structure.

The prop structure 1, as indicated in FIGS. 1 and 3, comprises four legs 6, four casters 7, a prop body 5 supported by the legs and casters, a stationary prop 8 attached to the prop body 5, and a movable prop 9 which may be slidably lifted or lowered. A balance spring 10 and a spring holder 11 are secured about an upper opening which is closed by a grip 13 and clamped by a screw 12. The spring holder 11 is provided integrally at the bottom thereof with a tube 14 surrounding the outer surface of the upper end of the balance spring 10 and at the top thereof with a tube 15 fitted within the inner surface of the lower end of the movable or sliding prop 9. The tube 15 is fixed to the sliding prop 9 by means of a screw 16 within the stationary prop 8. Although the spring holder 11 is movable within the stationary prop 8, such fixture may be accomplished readily as will be clear from the following description. As illustrated in FIG. 6, an engaging means is provided between the sliding prop 9 and the spring holder 11 to prevent changes in the relative position between a through hole 17 and a screwing opening 18. Around the upper end of the stationary prop 8 there is provided an opening 19 at the same level as the screwing opening 18 in the spring holder 11 located at its highest position. To secure the spring holder 11 on the sliding prop 9, the sliding prop 9 is fitted into the tube 15 of the spring holder 11 with the through hole 17 in which the screwing opening 18 and the sliding prop 9 are rotated relative to the spring holder 11 so that the openings 17 and 18 are located vis-a-vis the opening 19 through which the screw 16 is inserted. The balance spring 10 and the spring holder 11 are installed within the stationary prop 8 of which the upper end is closed by means of the grip 13. Thereafter, the sliding prop 9 is secured on the spring holder 11. The above structure leads to productivity of the prop structure 1 and provides a convenient structure for disassembly and packing.

The above described engaging means may comprise a protrusion 20 on the sliding prop 9 and a cutout 21 in the spring holder 11, for example. The opening 19 is closed by a cup 22. A sliding adjustment screw 23 is secured on the grip 13 to act on a grip ring 13' via a pressure plate 23', thereby holding the sliding prop 9 wherever desired. The lower end of the stationary prop 8 is protected by a body cover 24 which in turn is secured on the prop body 5. An earth terminal is labeled 25.

The balance spring 10 maintains the balance between the controller 2, the atomizer assembly 3, the bonnet 4 and so forth and prevents the sliding prop 9 from falling down all of a sudden when the adjustment screw 23 is loosened, and reduces the torque necessary for the sliding operation.

The controller 2 is inserted rotatably from the upper end of the sliding prop 9 and held in place by a clamping member 26 on the sliding prop 9. The clamping member 26 runs through the sliding prop 9 and is held by means of an opening 27, the sliding prop 9 and a fastening pin 28 which runs within the opening 27. The clamping member 26 is fixed so that the top of the controller 2 is located slightly above the top of the sliding prop 9.

Figure 4:
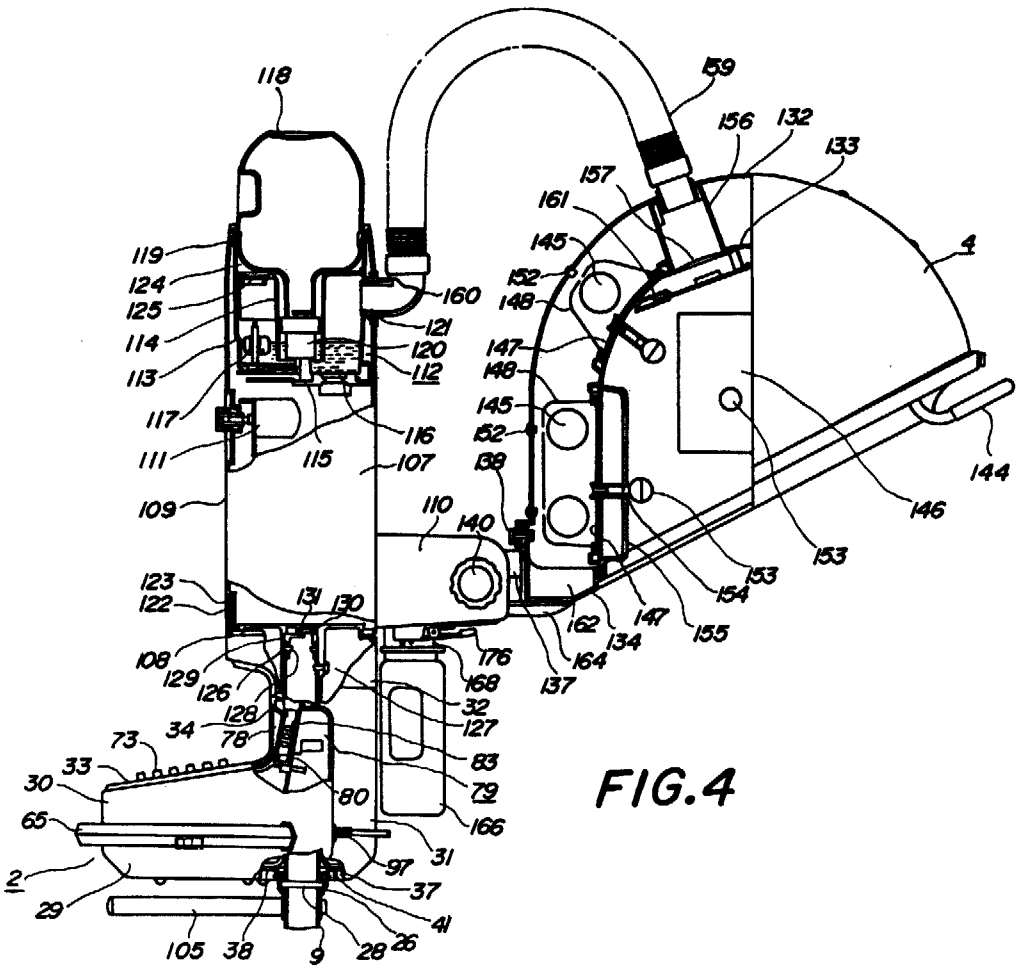
FIG. 4 is a cross-sectional view showing the relationship between the controller, the atomizer assembly and a bonnet.
Figure 5:
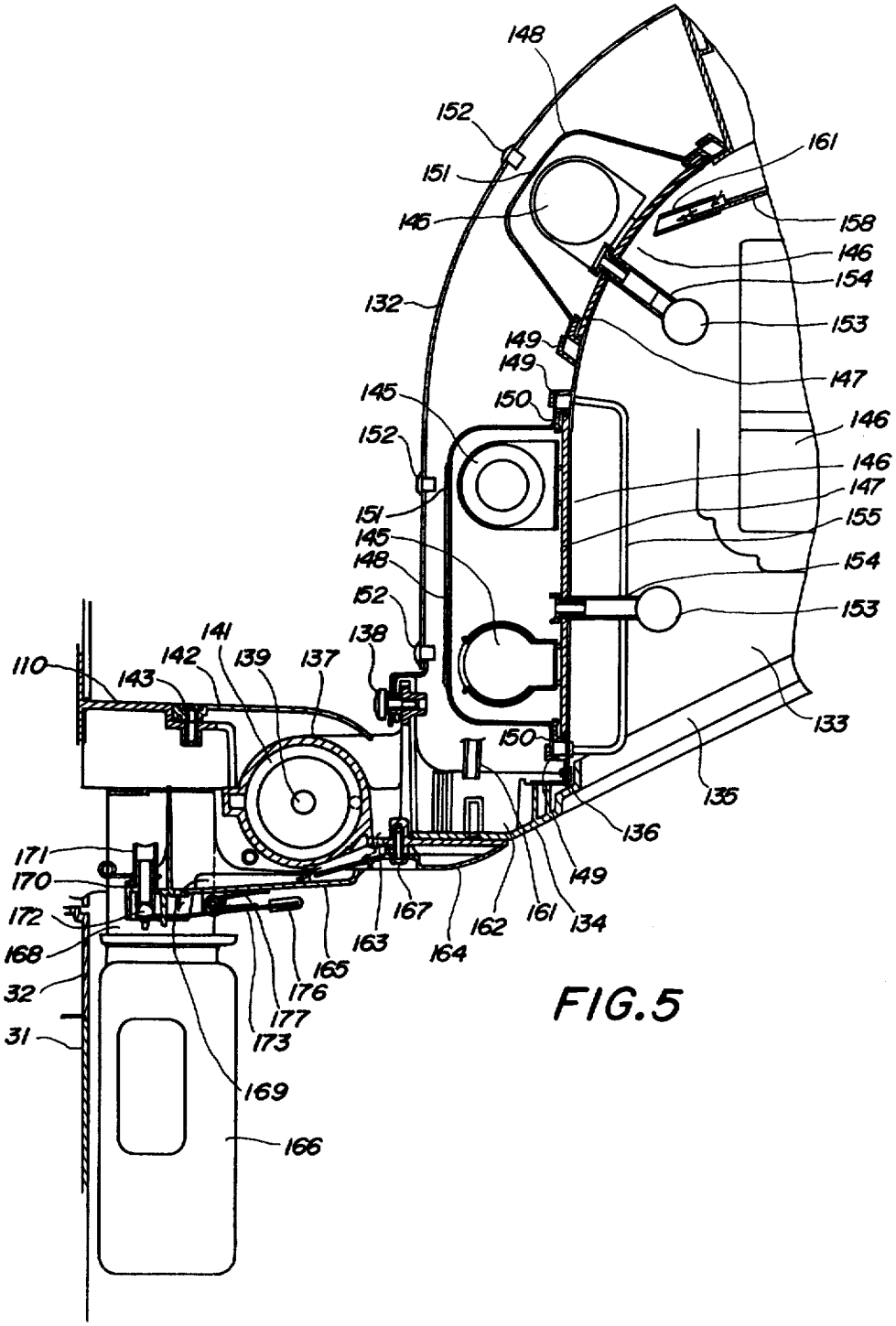
FIG. 5 is a cross-sectional view of the bonnet and its rotatable supporting structure.
Figure 10:
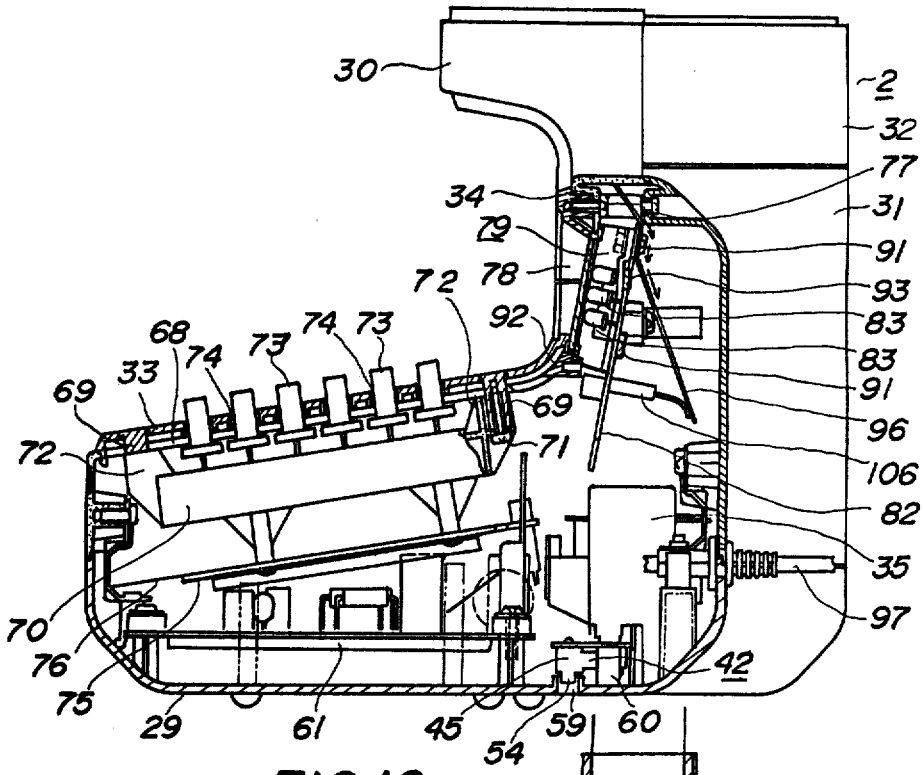
FIG. 10 is an elevational cross-sectional view of the controller.
Figure 11:
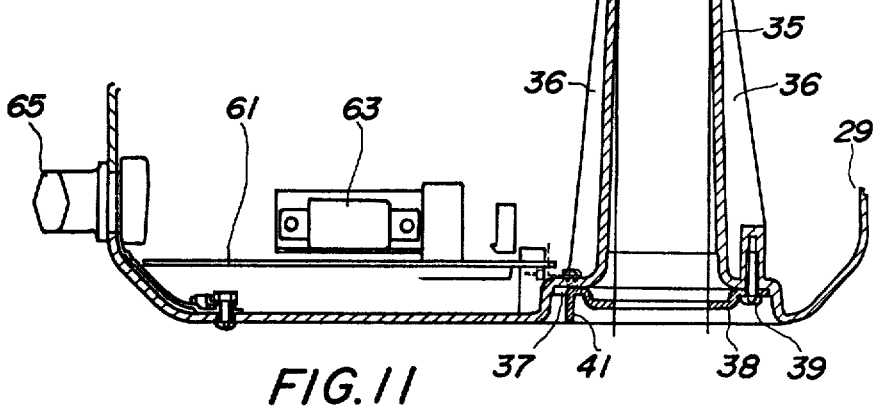
FIG. 11 is an elevational cross-sectional view of the lower housing member.
Figure 12:
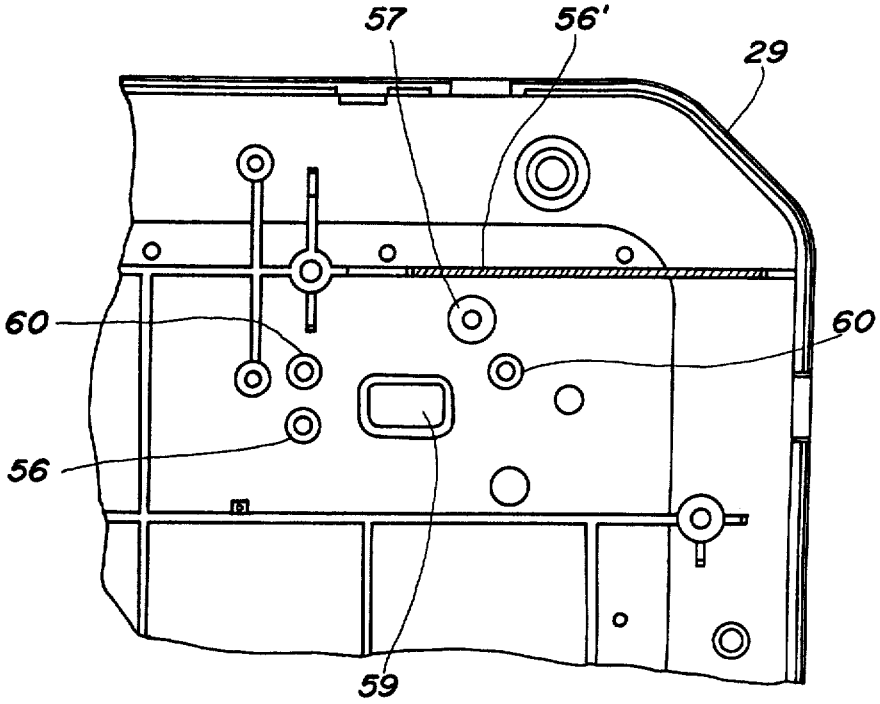
FIG. 12 is a plan view of the lower housing member.
Figure 13:
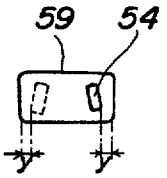
FIG. 13 is a representation of the relationship between a frequency switching knob and an operation aperture.
Figure 14:
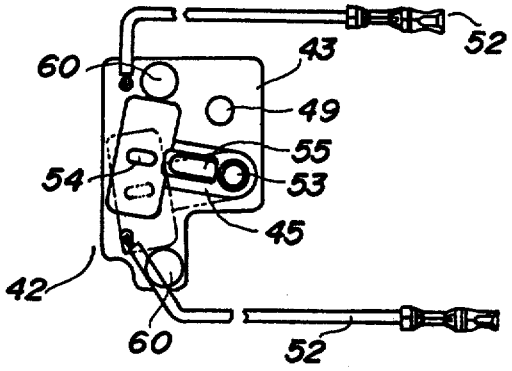
FIGS. 14(a) through 14(c) are a plan view, a side view and an elevational cross-sectional view of the frequency switching knob.
Figure 14:
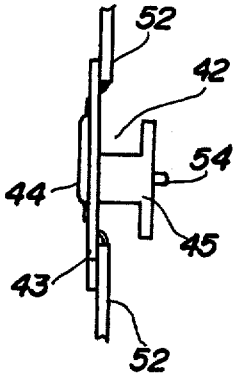

As illustrated in FIGS. 4, 10 and 11, a housing for the controller 2 comprises a lower member 29, an upper member 30, rear covers 31, 32 and panels 33, 34. The lower member 29 may be a plastic mold product and has an upwardly oriented sleeve 35 of a proper length and a plurality of ribs reinforcing the sleeve 35, as a unit. The sleeve 35 is provided at the bottom thereof with a wider extension 37 to which slide fittings 38 are secured through a screw 39. The slide fittings 38 are adapted not to protrude downwardly from the extension from a safety point of view. The lower member 29 of the housing is fitted into the sliding fittings 38, the last being in contact with the clamping member 26 in order to hold the controller 2 movable at a desired position.

The slide fittings 38 are to prevent the controller 2 from tilting with respect to the sliding prop 9 or shifting during rotation. Since the sleeve 35 is integral with the lower member 29, the diameter of the base end thereof is greater than that of the free end thereof due to a releasing inclination of a mold.

The slide fittings 38 are provided with means for restricting rotation of the controller 2 relative to the sliding prop 9. The restricting means comprises protrusions 40 disposed 180° apart about the clamping member 26 and raised strips 41 of the slide fittings 38, both of which serve to restrict the relative rotation of the controller 2. A permissible range of the relative rotation of the controller 2 is determined largely by its surrounding conditions, for example, the position of a water drain tunk to be described later. In the given example, the water drain tunk is located in a manner not to contact directly the controller 2. As an alternative, the fastening pin 28 may replace the protrusions 40.

Figure 15:
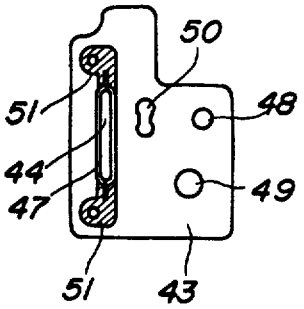
FIG. 15 is a plan view of a printed circuit board.
Figure 14:
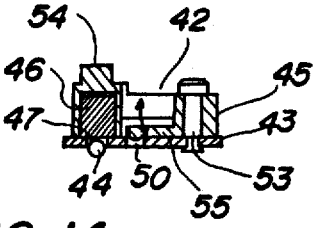

As illustrated in FIGS. 9 and 14(a)–14(c), a frequency switch 42 is located in place on the bottom of the lower member 29 of the housing. The switch 42 comprises a printed circuit board 43, a lead switch 44, an actuator 45 and a magnet 46. As indicated in FIG. 15, the printed circuit board 43 has an elongated hole 47 for installation of the lead switch 44, a calking hole 48, an installation hole 49 and a gourd-shaped hole 50. The printed circuit board 43 carries printed leads 51 on the rear side thereof about the elongated hole 47. The lead switch 44 is secured within the elongated hole 47, with the lead terminal thereof connected to the printed leads 51 which are communicated with external leads 52. The actuator 45 is movable by means of a pin 53 of which one end is fitted in the calking hole 48. The actuator 45 is disposed on the upper surface of the printed circuit board 43 and the magnet 46 is disposed on the free end of the board 43 to face against the lead switch 44. A knob 54 is provided oppositely to the magnet 46. The actuator 45 may be made of synthetic resin material with elasticity of which the center has a tonque 55. The tonque 55 is held selectively in the closing position and the opening position within the hole 50: the former where the lead switch 44 is closed by the action of the magnet 46 and the latter where the same is opened. The switching of the lead switch 44 causes changes in frequency.

The frequency switch 42 is located on the bottom of the lower member 29 of the housing and is secured by engagement between the printed circuit board 43, a rotation stopper 56 and a rib 56' and a screw 58 secured to a boss 57 via the opening 49. Under the circumstances the knob 54 associated with the actuator 45 does not extend external to the lower member 29 of the housing via an operation hole 59. The cooperation of the hole 50 and the tongue 55 prevents excessive rotations of the actuator 45. A force which is too strong tends to disengage the tongue 55 from the hole 50. Stopper bosses 60 are also provided integrally with the lower member 29 of the housing to prevent excessive rotations of the actuator 45. The bosses 60 engage with the actuator 45 when the tongue 55 runs through the hole 50. The knob 54 does not come into contact with the operation opening 59 unless the bosses 60 engage with the actuator 45.

A spacing y is always present between both sides of the knob 54 and apart from the opening 59, thereby facilitating manipulation of the knob 54.

The bosses 60 can be eliminated. In this instance ribs are formed on both sides of the knob 54 of the actuator 45 and kept in contact with the opening 59, thereby preventing the excessive rotations of the actuator 45. The spacing y may be always provided between the knob 54 and the opening 59. As a further means, recesses may be formed on both sides of the knob 54 for the insertion of a screw driver, etc.

Since the frequency switch 42 comprises the lead switch 44, there is no possibility that a waving agent will erode the contact area of the frequency switch, thereby ensuring a higher degree of reliability of the switch.

As illustrated in FIGS. 9, 10 and 11, on the bottom of the lower member 29 of the housing there are provided a control circuit board 61 carrying control elements such as a micro processor, a transformer 62 and a power switch 63 having a knob 64 exposed to the exterior of the assembly via the lower member 29.

The upper member 30 engages with the front half of the lower member 29 to provide a front housing for the controller 2. Likewise the lower member 29, and the upper member 30 may be made of a plastic mold product. Legs 66 of a bumper 65 are held between the upper housing member 30 and the lower housing member 29 for installation of the bumber 65. Engaging means 67 on the legs 66 prevent the removal of the bumper 65.

The upper housing member 30 has a wider opening at the center thereof, in which the panels 33, 34 are affixed. The panel 33 is made of a plastic mold product provided integrally with a plurality of bosses 69 on the rear side thereof and is of a sufficient size such that the periphery thereof abuts on the opening 68 in the upper housing member 30. A keyboard switch 70 is mounted on the bosses 69 by means of a screw 71, which switch 70 has a plurality of ribs 72 in contact with the inner surface of the upper housing member 30. The lower housing member 29 is for installation of the bumper 65. Engaging means 67 on the legs 66 prevent the removal of the bumper 65.

The upper housing member 30 has a wider opening at the center thereof, in which the panels 33, 34 are affixed. The panel 33 is made of a plastic mold product provided integrally with a plurality of bosses 69 on the rear side thereof and is of a sufficient size such that the periphery thereof abuts on the opening 68 in the upper housing member 30. A keyboard switch 70 is mounted on the bosses 69 by means of a screw 71, which switch 70 has a plurality of ribs 72 in contact with the inner surface of the upper housing member 30. The window 78 at the junction between the panels 33, 34. As will be clear later, a remaining duration display 79 is disposed in the display window 78.

As illustrated in FIGS. 18–21, the remaining duration display 79 comprises a colorless, transparent display plate 80, an elastic and colored, for example, red sheet 81, a display element 83 of, for example, light emitting diodes and a digital time display (not shown) mounted on a board 82. Installation means 85 are formed on the both sides of the display plate 80 via a step region 84 and provided at the center thereof with a filter 86 leading to the colored sheet 81. Grooves 87 are formed in both sides of the filter 86 for receiving tongues 88 of the colored sheet 81. Due to the elasticity of the colored sheet 81, the sheet 81 is held in contact with the rear of the filter 86 while the tongues 88 are inserted into the grooves 87. The colored sheet 81 has a plurality of, say three, openings 89 for the display elements 83 indicating the completion of preheating operation, 25 min operation and 20 min operation. It is desirable that the preheating operation display element 83 be implemented with a green light emitting diode and the 25 min and 20 min operation display elements with a red light emitting diode.

Figure 17:
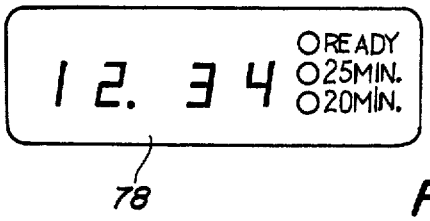
FIG. 17 is a representation of a display window.
Figure 18:
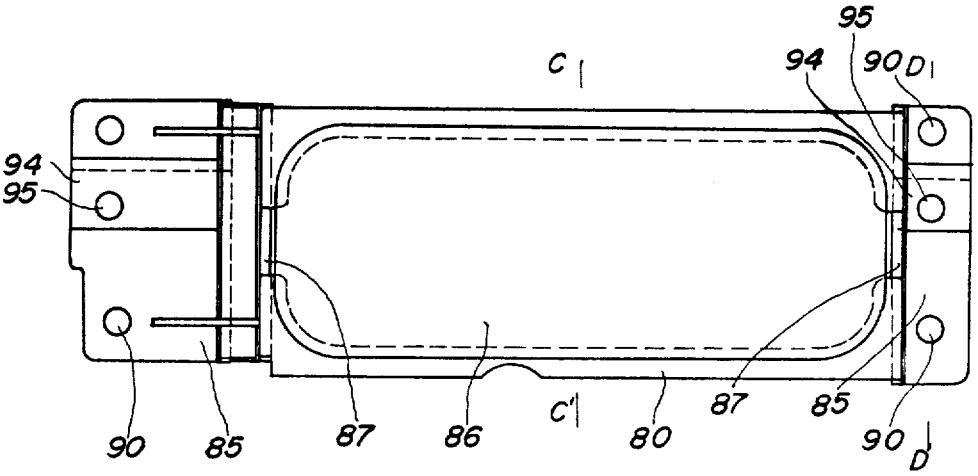
FIG. 18 is a front view of a display plate.
Figure 19:
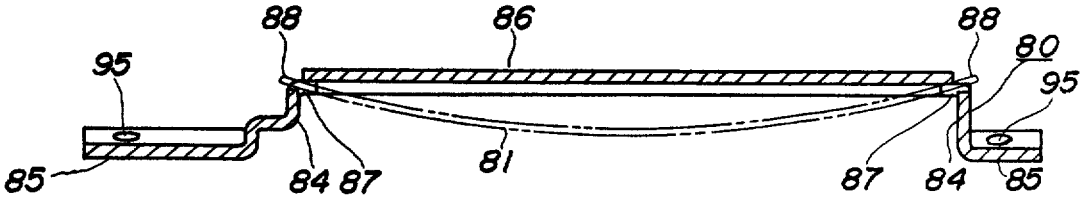
FIG. 19 is a cross-sectional view of the display plate.
Figure 20:
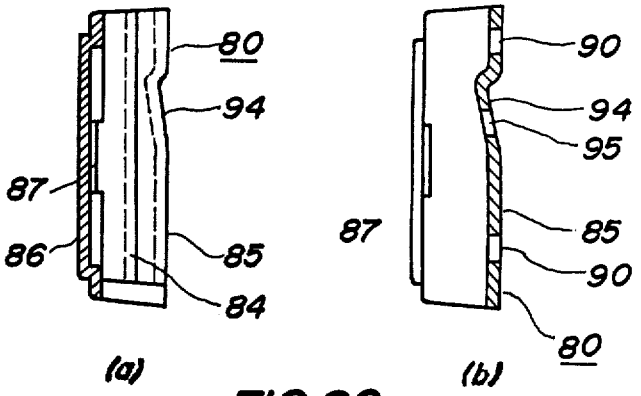
FIGS. 20(a) and 20(b) are cross-sectional views along the lines C—C and D—D of FIG. 18.
Figure 21:
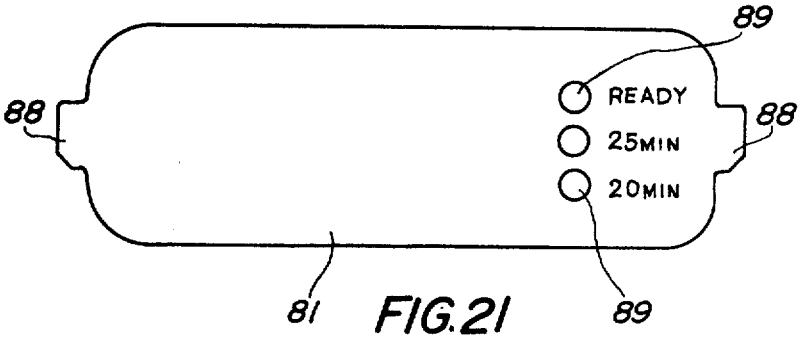
FIG. 21 is a plan view of a colored sheet.

The display plate 80 is secured on the board 82 by means of a plurality of screw holes 90 and screws 91. Under the circumstance the respective display elements 83 are located beneath the openings 89 in the colored sheet 81. Displays on the display elements 83 are viewable through the filter 86 and a time display in the display window 78 is viewable through the colored sheet 81 and the filter 86 as indicated in FIG. 17.

The remaining duration display 79 is positioned by a stopper 92 on the upper housing member 30 and secured on the upper housing member 30 by means of a screw 93. After passing through an opening 95 in an inclined surface 94 of the display plate 80, the screw 93 is screwed into bosses on the upper housing member 30. The time display 79 is made readily viewable with a proper inclination since the bosses abut on the inclined surface 94.

A water proof sheet 96 is secured via a screw 91 together with the board 82 for protection of the board 82 against invasion of water. Water drops on the display window 78 are prevented from approaching the circuit board 82 and so forth and resulting in destruction of electrical isolation.

The rear cover 31 may be made of plastic material and abut on the rear half of the lower housing member 29. The rear cover 31 holds a power cord 97 with the aid of the lower housing member 30. The power cord 97 is led from the controller 2. The rear cover 31 presses a speaker 98 installed inside of the lower housing member 29.

Figure 22:
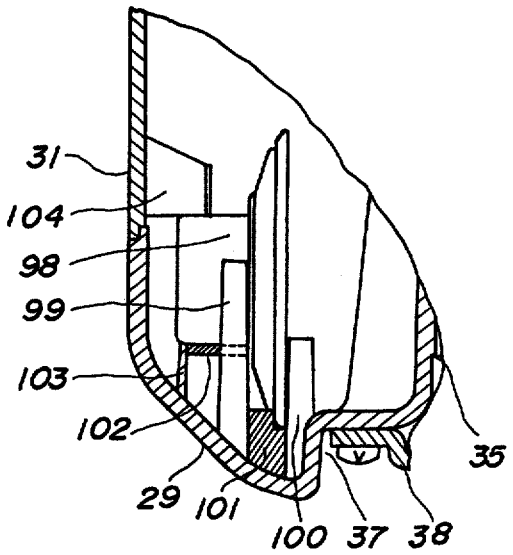
FIG. 22 is a cross-sectional view of means for supporting a speaker.

As illustrated in FIG. 9, the lower housing member 29 has as a unit a pair of bosses 99 holding a magnet of the speaker 98, a boss 100 positioning a horn of the speaker 98, a rib 101 and a rib 103 for positioning of a bumper 102. As viewed from FIG. 22, the speaker 98 is held by the bosses 99, 100 and the rib 101 in such a manner that the magnet is directly in contact with the bumper 102. Preferably, the bumper 102 is made of rubber material having a higher elasticity and a greater coefficient of friction to prevent the speaker 98 from rotating due to friction with the magnet and reduce the accompanying tension exerted upon the external leads thereof. The speaker 98 is to advise the user of shortage of water in the atomizer assembly actuation of the keyboard 70.

The rear cover 32 is connected to the rear cover 31 to surround the upper end of the sliding prop 9 together with the upper housing member 30. In FIG. 4, a handle 105 is provided for adjusting the heights of the controller 2, the atomizer assembly 3 and the bonnet 4 on the sliding prop 9. In FIG. 10, a connector to the interior of the controller 2 is labeled 106.

As illustrated in FIG. 4, the atomizer 3 comprises a semicylindrical bottom plate 108, a base 107 integral with the bottom plate 108 and a semicylindrical cover 109. The base 107 may be made by the die casting technique and provided integrally with a support arm 110 which rotatably holds the bonnet 4.

Within the atomizer assembly 3 there are provided a blower (not shown), a transformer (not shown), an atomizer adjustment switch 111, and ultrasonic atomizer fittings 112 from bottom to top, all of which are secured on the inner surface of the base 107. The atomizer fittings 112 include a water reservoir 113, a reservoir lid 114, an ultrasonic oscillator 115, an ultrasonic vibrator 116 and a float switch 117, etc. to generate mist at room temperature by ultrasonic vibration in a conventional manner. Replenishment of water is accomplished by the provision of a feeder container 118 which is mounted on the reservoir lid 114 with the upper end down. The water reservoir 113 is held in the airtight condition by the use of a packing. The feed water container 118 is provided with a valve 120 which is open to feed water to the reservoir 113 when the container 118 is face down mounted. The float switch 117 detects shortage of water in the feed water container 118 or the reservoir 113 and, in the absence of water, disables the ultrasonic oscillator 115 for protection of the vibrator 116. A joint opening 121 is so formed in the water reservoir 113 as to be exposed outside via the base 107. An air intake 122 is formed in the lower portion of the lid 109 and loaded with a filter 123.

Air induced via the intake 122 runs into a ventilation 124 in the water reservoir 113 while cooling the transformer and the ultrasonic atomizer components 112. After passing through the ventilation 124, the induced air enters into the feed water container 118 and reaches the interior of the water reservoir 113 via a joint opening 125 in the water reservoir lid 114 so that the mixture of the induced air and the mist generated from the vibrator 116 is guided into the joint opening 121 and then injected into the interior of the bonnet 4.

The atomizer assembly 3 is rotatably secured on the upper end of the sliding prop 9 within a limited angle (say, about 20 degrees). A cylinder 126 is integral with the bottom plate 108 of the base 107 which bottom plate is rotatable at the upper end of the sliding prop 9 with the aid of the cylinder 126. The engaging relationship between a screw 127 in the cylinder and a slit formed in the sliding prop 9 prevents the base 107 from being removed from its position but has no effects in defining the rotation range.

As illustrated in FIG. 4, a neck swinging structure for defining the rotation range comprises a neck swinging ring 129 made by the die casting technique and secured on the upper end of the sliding prop 9 by means of a pin 128, a protrusion 130 formed on the ring 129 and an arc shape groove 131 formed in the bottom plate 108 for receiving the protrusion 130. The rotation range of the atomizer assembly 3 is confined by the engaging relationship between the protrusion 130 and the arc shaped groove 131.

The bonnet 4 is of a double structure comprising a plastic-made, hemispherical outer cover 132 and a metal-made, hemispherical inner cover 133, both of which are secured on a bonnet ring 134 of plastic material by means of screws and a proper spacing therebetween. A rising wall 135 is provided on the inner edge of the bonnet ring 134, which defines a drain 136 in cooperation with the inner surface of the inner cover 133. The bonnet 4 is adjustable in angle of elevation with respect to a support arm 110 by securing a neck piece 137 in place by a screw 138 and securing the neck piece 137 movable on the support arm 110 by a neck bolt 139. An elevation angle adjusting knob 140 is provided for selection of the stationary state and the adjustable state in response to fastening and unfastening operation for the neck bolt 139. A balance spring 141 is secured between the neck piece 137 and the support arm 110. A neck cover 142 is secured on the support arm 110 by a screw 143 to cover the neck piece 137. A bonnet handle 144 is fixed on the outer face of the bonnet 4 and opposed to the neck piece 137. The bonnet ring 134 is inclined gradually with the neck piece side thereof at the lowest level.

Infrared lamps 145, sources of heat, are disposed within the interior of the bonnet 4 and thus on the outer face of the inner cover 133, each of the infrared lamps corresponding to a respective one of a plurality of the hairline regions, for example, five regions (the front head, head top, head back, head left side and head right side regions). One or more infrared lamps are provided for each of the hairline regions. Radiation windows 146 for the infrared lamps 145 are formed in the inner cover 133 and overlaid with a transparent plate 147 of glass or heat proof resin material. A reflector 148 is disposed outside the infrared lamps 145 by the engaging relationship between engaging members 149 and extending member 150. An aperture 151 is formed in the reflector 148 in a position to correspond to the infrared lamps 145. A display window 152 of transparent plastic material is formed in the outer cover 132 to confirm energization, disenergization and failure of the infrared lamps 145.

A temperature sensor 153, for example, a thermistor is disposed on the transparent plate 147 via a flexible arm 154 and held in contact with the hair line regions to monitor the temperature of hair and control current supply to the infrared lamps 145. The temperature sensors 153 are provided one for each of the hairline regions for controlling operation of the infrared lamps.

A guard 155 protects the radiation window 146 and is provided particularly for the head rear region. The guard 155 is made of wires and extended between the upper and lower edges of the radiation window 146. It is desirable that the guard 155 be extended in a longitudinal direction since the length of curler rods on the head rear region is often positioned in a horizontal direction. If necessary, the guard 155 may be also provided for other radiation windows 146.

An atomizer tube 156 leading to the outer cover 132 and the inner cover 133 is provided at the top of the bonnet 4. An obstacle plate 158 is provided at the inner end of the atomizer tube 156 for the purpose of distributing the mist ejected from the atomizer tube 156 throughout the interior of the bonnet 4. The outer end of the atomizer tube 156 is connected to a flexible atomizer hose 159 and then the joint aperture 121 in the atomizer assembly 3. The other end of the atomizer hose 159 is connected to an elbow 160 movable about the joint aperature 121. Although the mist from the joint aperture 121 is greatly variable in flowing direction, the elbow 160 serves the purpose of keeping the area of a passageway unchanged as in the flexible hose and thus guiding smoothly the mist into the atomizer hose 159.

The lowest end of the obstacle plate 158 is connected to a drain hose 161 to direct water drops on the obstacle plate 158 to the lowest end of the bonnet ring 34 and to a water collector 162 to prevent the water drops from falling directly on the floor, etc. The water collector 162 includes a drain 136 for receiving water drops on the inner face of the inner cover 133.

Figure 23:
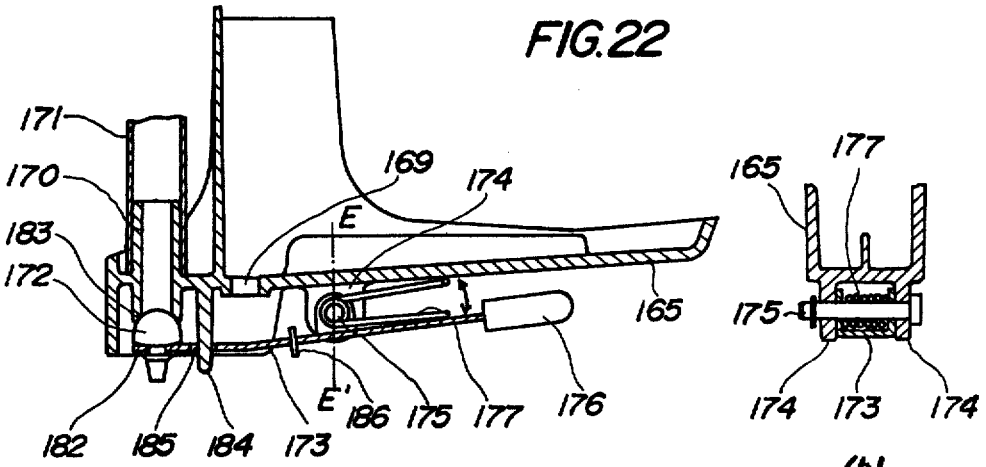
FIGS. 23(a) and 23(b) are a cross-sectional view of a drain structure and a cross-sectional view taken along the line E—E of FIG. 23(a)
Figure 24:
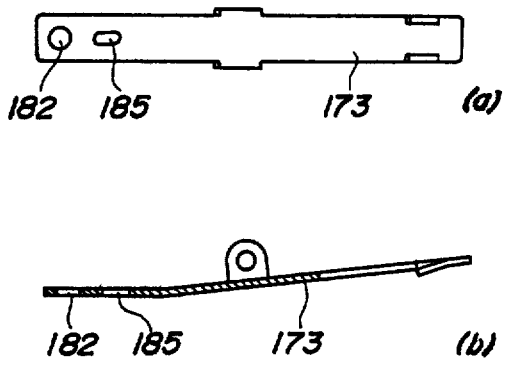
FIGS. 24(a) and 24(b) are a plan view and a cross-sectional view of a water drain lever.

Drain water collected in the collector 162 is led into a discharge water tank 166 via an outlet 163 in the neck piece 137, a first drain 164 and a second drain 165. The first drain 164 is secured tightly on the neck piece 137 by means of a screw 167 to cover the outlet 163, leading drain water into the second drain 165. As best seen from FIG. 23, the second drain 165 may be a plastic mold product and secured via a tank holding member 168 and a screw on the base 107, allowing the drain water to fall into the drain water tank 166 via a hole 169. The drain water tank 166 is removably secured by the holding member 168.

A drain tube 170 is integral with the second drain 165 and connected to a drain hose 171 communicating with the bottom of the water reservoir 113.

A valve 172 is provided at the lower end of the drain tube 170 to open and close a drain lever 173. The drain lever 173 is pivoted at its center via a pin 175 on a pair of bearing ribs 174 located below the second drain 165 and has its one end leading to the drain tube 170 and carrying the value 172 and its other end carrying a knob 176. The drain lever 173 is biased in the direction of always closing the valve 172 by the force of a rewind spring 177 wound around a pin 175.

Figure 25:
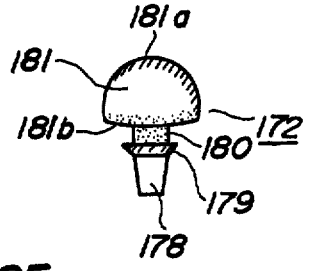
FIG. 25 is a front view of a valve assembly.

The valve 172 of elastic material such as rubber, as indicated in FIG. 25, comprises a guide 178, a stopper 179, a shaft 180 and a main body 181. By pressing the guide 178, the stopper 179 and the shaft 180 into a support hole 182 in the drain lever 173, the valve assembly 172 is tightly secured on the drain lever 173. A closing surface 181*a* and a lever bearing surface 181*b* of the valve assembly 181 are of a globe shape, while a valve seat 183 of the drain tube 170 is of a globe shape which mates with the closing surface 181*a*.

A guide 184 is integral with the second drain 165 and received freely within an elongated hole 185 formed in the drain lever 173.

The valve 172 of elastic material can tolerate the dimension or assembly deviations of the second drain 165, the drain lever 173 and the valve 172 because the closing surface 181*a* and the lever bearing surface 181*b* of the valve body 181 and the valve seat 183 are of a globe shape. Thus, the valve seat 183 is held in watertight contact with the closing surface 181*a*.

When the valve 172 occupies its closed position, the knob side 176 of the drain lever 173 is located above the remaining part thereof, preventing the water drops on the drain lever 173 from falling from out of the drain water tank 166 along the lever 173. A cutwater 186 is provided on the drain lever 173. The drain water tank 166 collects the drain water from the bonnet 4 and the water reservoir 113.

Figure 16:
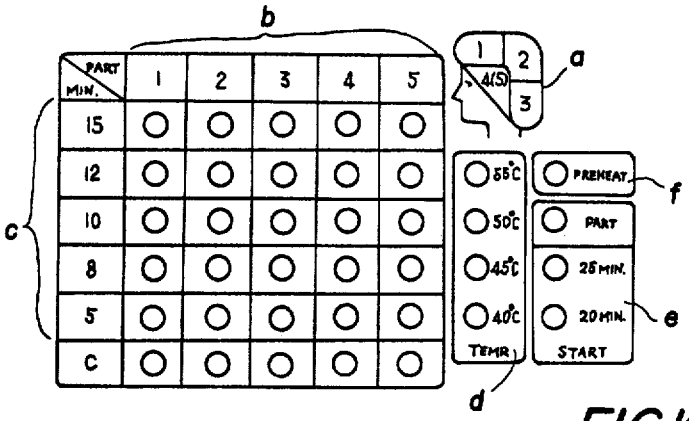
FIG. 16 is a representation of a panel.

In FIG. 16, (a) denotes a hairline region identifying number display, (b) denotes a region number display, (c) denotes a duration display, (d) denotes a temperature display, (e) denotes a start operation display and (f) denotes a preheat operation display.

The above described heating type waving appliance will operate in the following manner. The feed water tank 118 is disposed on the reservoir 113. The power switch 63 is turned on and the mist quantity adjustment switch 111 is set to select quantity. Adjustment switch 111 is set to select a desired amount of the mist.

The keyboard switches 70 of the controller 2 are manually operated to set heating durations for each of the hairline regions. When it is desired to keep all the heating durations for the respective hairline regions equal to one another, say, 20 min or 25 min, the key 73 needs not to be operated. In the case where it is desired to set different heating durations for the respective ones of the hairline regions, the key 73 is operated to set desired heating durations for the respective hairline regions.

The key 73 corresponding to the desired temperature in the temperature display (d) is operated to set desired heating temperatures for the respective regions and thereafter the key 73 on the preheating operation display (f) is manually operated. As a result, the infrared lamps 145 all start preheating and, when the desired temperature for a particular region is reached, the temperature sensor 153 becomes operative to energize the display element 83 indicating the completion of the preheating operation. The preheating duration is not included in the heating duration settings by the keyboard switch 70.

Hair of the patron is wound around the curler rods and a weaker waving agent is distributed throughout the hair. Under the circumstances the hairline regions of the patrons head are located inside the preheated bonnet 4. The respective temperature sensors come into contact with hair.

Subsequently, the desired key 73 on the start operation display (e) is manually operated. The key 73 corresponding to the desired heating temperature is operated so that the respective infrared lamps 145 start heating the hair and the remaining duration of the heating operation is displayed through the display window 78. The atomizer 3 also starts operating.

The heating operations by the infrared lamps 145 are controlled independently or differently from one region to another. In other words, the temperature sensors 153 in the respective regions monitor the temperatures of hair and control the infrared lamps 145, keeping the heating temperature different from one region to another. Under such heating condition, the hair is laden with moisture by the mist generated from the atomizer assembly 3. The waving agent is satisfactorily reacted with the hair without being dried up.

The heating operation continues until the heating duration settings expire and discontinues upon the passage of the heating duration settings. Upon the completion of the heating operation the speaker 98 releases an audible sound and the atomizer assembly 3 also discontinue the generation of the mist.

Whereas the present invention has been described with respect to a specific embodiment thereof, it will be understood that various changes and modifications will be suggested to one skilled in the art, and it is intended to encompass such changes and modifications as fall within the scope of the appended claims.

I claim:

1. A heating type hair waving appliance comprising:

a hood supporting assembly in which the head of a patron is positioned;

a plurality of independently controllable heating means provided within said hood supporting assembly for heating different hairline areas of the head of a patron;

atomizer means provided within said hood supporting assembly for generating moisture-laden air mist at room temperature, imparting moisture to the hair being heated by said heating means;

a controller containing a plurality of controlling elements for controlling the operation of said heating means;

rotatable supporting means for said controller, said supporting means comprising means for confining a range of rotation of said controller relative to said hood supporting assembly; and a supporting structure including a base member, adapted to be positioned on a floor surface, a stationary prop structure attached to said base member and extending upwardly therefrom, and a movable prop structure slidable mounted within said stationary prop structure and attached to said hood supporting assembly to permit an adjustment of the height of said hood supporting assembly relative to said floor surface;

said rotatable supporting means including a sleeve extending through a housing for said controller and being rotatably positioned on said movable prop structure, a slide fitting being positioned adjacent to said sleeve including at least one raised strip extending therefrom, a restricting means including at least one protrusion adapted to mate with said raised strip of said slide fitting to limit the rotation of said controller housing relative to said hood supporting assembly.

2. A heating type hair waving appliance comprising:

a bonnet in which the head of a patron is positioned;

a plurality of heating means provided within said bonnet for heating different hairline areas of the head of a patron;

atomizer means operatively connected to said bonnet for generating moisture-laden air mist at room temperature;

controller means containing a plurality of controlling elements for controlling the operation of said plurality of the heating means;

a movable prop structure for securing said bonnet, said atomizer means and said controller means, said controller means being movable with respect to said bonnet;

a supporting structure including a base member, adapted to be positioned on a floor surface, a stationary prop structure attached to said base member and extending upwardly therefrom, and said movable prop structure being slidable mounted within said stationary prop structure and attached to said bonnet to permit an adjustment of the height of said bonnet relative to said floor surface; and a rotatable supporting means including a sleeve extending through a housing for said controller and being rotatably positioned on said movable prop structure, a slide fitting being positioned adjacent to said sleeve including at least one raised strip extending therefrom, a restricting means including at least one protrusion adapted to mate with said raised strip of said slide fitting to limit the rotation of said controller housing relative to said bonnet.

3. A heating type hair waving appliance according to claims 1 or 2, wherein said movable prop structure includes a holder attached to a lower end thereof, and a spring means being operatively disposed between said holder and said base member to urge said movable prop structure upwardly, said movable prop structure being secured relative to said stationary prop structure by means of a clamping means.

4. The heating type hair waving appliance according to claim 2 wherein said controller is provided with a sleeve of which one end carries a slide member, said controller being rotatable by means of said sleeve and said slide member, and said rotation restricting means being interposed between said slide member and said prop structure.

5. A heating type hair waving appliance according to claim 3, wherein said holder is removably secured to said movable prop structure by an attaching member which is removable through an opening in said stationary prop member to permit disassembly of said movable prop structure from said stationary prop structure.

6. A heating type hair waving appliance according to claim 3, wherein said clamping means comprises a knob including a radially displacable member for affixing said stationary prop structure relative to said movable prop structure.

7. A heating type hair waving appliance according to claims 1 or 2, wherein said controller includes a plurality of controlling elements for selectively, independently controlling said heating means for a predetermined time period and at a predetermined temperature.

8. A heating type hair waving appliance according to claim 1 or 2, wherein said slide fitting includes two raised strips disposed approximately 180° relative to each other and said restricting means includes two protrusions disposed approximately 180° relative to each other.

9. A heating type hair waving appliance according to claim 7, wherein said controller includes a display panel including a time display portion and an operation display portion.

10. A heating type hair waving appliance according to claim 9, and further including a speaker means for issuing an audible sound upon completion of the heating operation.

11. A heating type hair waving appliance comprising:

a hood supporting assembly in which the head of a patron is positioned;

a plurality of independently controllable heating means provided within said hood supporting assembly for heating different hairline areas of the head of a patron;

atomizer means provided within said hood supporting assembly for generating moisture-laden air mist at room temperature, imparting moisture to the hair being heated by said heating means;

a controller containing a plurality of controlling elements for controlling the operation of said heating means; and rotatable supporting means for said controller, said rotatable supporting means comprising means for confining a range of rotation of said controller relative to said head supporting assembly;

a supporting structure including a base member, adapted to be positioned on a floor surface, a stationary prop structure attached to said base member and extending upwardly therefrom, and a movable prop structure slidable mounted within said stationary prop structure and attached to said hood supporting assembly to permit an adjustment of the height of said hood supporting assembly relative to said floor surface;

said atomizer being operatively positioned on said controller and including an atomizer housing wherein a removable liquid supply container may be operatively positioned adjacent an upper portion of said atomizer housing for supply liquid to said atomizer, said atomizer housing including an ultrasonic oscillator, a reservoir and a float switch operatively positioned in said reservoir and operatively connected to said ultrasonic oscillator to disable said ultrasonic oscillator when the liquid in said reservoir drops below a predetermined level.

* * * * *